United States Patent [19]

Giebel

[11] 4,249,279

[45] Feb. 10, 1981

[54] SHOE BACKPART MOLDING MACHINE

[75] Inventor: Gerhard Giebel, Neuenhain, Fed. Rep. of Germany

[73] Assignee: USM Corporation, Farmington, Conn.

[21] Appl. No.: 81,280

[22] Filed: Oct. 3, 1979

[30] Foreign Application Priority Data

Oct. 18, 1978 [DE] Fed. Rep. of Germany ... 7831063[U]

[51] Int. Cl.[3] ..... A43D 11/00

[52] U.S. Cl. ..... 12/54.3; 12/53.5

[58] Field of Search ..... 12/54.3, 54.2, 53.5, 12/16.1, 16.4

[56] References Cited

U.S. PATENT DOCUMENTS

| | | | |
|---|---|---|---|
| 2,983,934 | 5/1961 | Bertrand | 12/54.3 |
| 3,345,661 | 10/1967 | Wilisch | 12/54.3 |
| 3,775,796 | 12/1973 | Schindler et al. | 12/54.3 |

FOREIGN PATENT DOCUMENTS

| | | | |
|---|---|---|---|
| 2627347 | 12/1976 | Fed. Rep. of Germany | 12/54.3 |

*Primary Examiner*—Patrick D. Lawson

*Attorney, Agent, or Firm*—Donald N. Halgren; Vincent A. White

[57] ABSTRACT

An outer molding band for a shoe upper backpart portion molding machine comprises two support portions, each carrying a block of relatively hard rubber, each block in turn carrying a molding cushion which is shaped to the shape of an inner mold. A cover, which acts as a diaphragm, to which air may be admitted, is arranged between the diaphragm and the support portion, to press the block, and thus the mold cushion carried therewith, against the inner form. The two support portions are pivotable inwardly to a position in which the mold cushions supported thereby engage the inner mold, or a shoe upper placed over the inner mold, and where air may be admitted as aforementioned, to apply a molding pressure to that shoe upper.

12 Claims, 3 Drawing Figures

SHOE BACKPART MOLDING MACHINE

BACKGROUND OF THE INVENTION

1. Field of the Invention

This invention relates to shoe machines and more particularly to a shoe backpart portion molding machine.

2. Prior Art

Shoe backpart molding machines are used in shoe manufacture to draft or form the shoe upper lengthwise after insertion of a stiffener, to form and mold the heel portion thereof and to simultaneously wipe the lasting margin in the heel end region. The shoe upper is thus placed on a heated inner form with the counter inserted in the heel portion thereof. An arrangement of side pincers beneath the inner form grip the shoe upper, and a heated rubber outer form, which is arranged into support portions which are pivotable and inflatable, mold the backpart of the shoe upper. When the outer form is lowered, it first engages the upper and the inner form in the region of the back seam, then the support portions swing inwardly. After the closing operation, the support portions are inflated on their inside and thus press the outer mold to the tensioned upper.

Such a prior art shoe backpart molding machine has the disadvantage of having an outer mold which is liable to damage because of the unitary inflatable membrane contained therein. In practice this membrane can be sealed only with difficulty. The edges quickly wear out and break after a short period of time because they are pressed almost completely flat in the rest condition. The elements are difficult to mount and to maintain. The unitary hollow air cushion gives rise also to an unsatisfactory pressing of the upper on the inner form.

It is an object of the present invention to produce a backpart molding machine which is simple to produce, easier to assemble and maintain, and less liable to wear than the prior art backpart molding machines.

BRIEF SUMMARY OF THE INVENTION

The present invention concerns a shoe backpart molding machine which includes a heatable inner form, an arrangement of pincers for drafting the shoe upper over the inner form, and a heatable outer form, which together with the inner form, molds the backpart of the shoe upper, and which comprises two pivotable support portions, at least one elastic mold cushion and a device by which an air cushion can be formed between the support portions and the mold cushion. Each support portion has a block which is moveable in a direction towards the inner form upon the filling of the air cushion. When the mold cushion is activated to press the upper against the inner form, the support portions are closed so that the mold cushion lies on the inner form. Certain pressure is thereby applied to the shoe upper lying on the inner form. The air cushion is then activated, which moves the block in the manner of a presser through a certain distance in a direction towards the inner mold to increase the pressure on the mold cushion and thus on the shoe upper. The air cushion need not be contained in a membrane which is closed on all of its sides. The block executes only a small movement, for example from 1 to about 4 mm, thus permitting the air cushion to have a very small volume and the use of air can be kept very low. No bowed or even bent membranes are necessary, so that wear does not occur. The air cushion arrangement can be kept compact to permit more space for the inner mold wiping mechanism or a spreader mechanism. The simple geometric shapes which the block can assume permits a more direct pressure of the mold cushion against the inner mold and with the shoe upper.

The block may extend over the whole side region of the heel portion of the inner mold, thereby permitting a uniform application of pressure by the mold cushion. The block may be comprised of an elastic material of relatively high hardness. The block should be able to apply the pressure created by the air cushion as well as have a certain elasticity in order to maintain the loading of the mold cushion at a lower level and reduce its wear.

The backpart molding machine also comprises a frame arranged with the support portion for guiding the block. The block has side walls which run parallel to the inner walls of the frame and which can slide in relation to the frame. The sliding relationship may be facilitated by having adjacent contiguous faces provided with a slipping material. An air tight cover is arranged between each support portion and each block. This cover defines the air cushion which is formed between the support portion and the block. The air cushion can thus be formed without having the block secured to the frame in an air tight condition. The cover can be secured by laying it on the support portion and then disposing the frame thereon and connecting the frame with the support portion by an arrangement of bolts. The mold cushion is thus made air tight up to its edges in this manner.

The surface of the block which faces away from the inner mold, that is, the outer surface of the block, matches the surface facing the inner form of the support portion, that is the inner surface of the support portion. This means that no significant spaces are present between the block and the support portion in the rest condition when the block is withdrawn. This is particularly advantageous when the faces are essentially flat. The face of the block adjacent the inner form is preferentially flat and parallel to the central surface of the inner mold, permitting a uniform transfer pressure to the mold cushion.

A rigid disc of thermoplastic polyester such as polyethylene terephthalate (PET) can be loosely mounted for movement between the block and the cover to simplify movement between the block and the cover during formation of and collapse of the air cushion. An air feed line supplies pressurizable air through the side portions to the vicinity of the air cushion. Other pressurizable fluids may be utilized instead of air to inflate the cushion.

BRIEF DESCRIPTION OF THE DRAWINGS

The objects and advantages of the present invention will become more apparent when viewed in conjunction with the following drawings, in which.

DESCRIPTION OF THE PREFERRED EMBODIMENT

Figure 2:
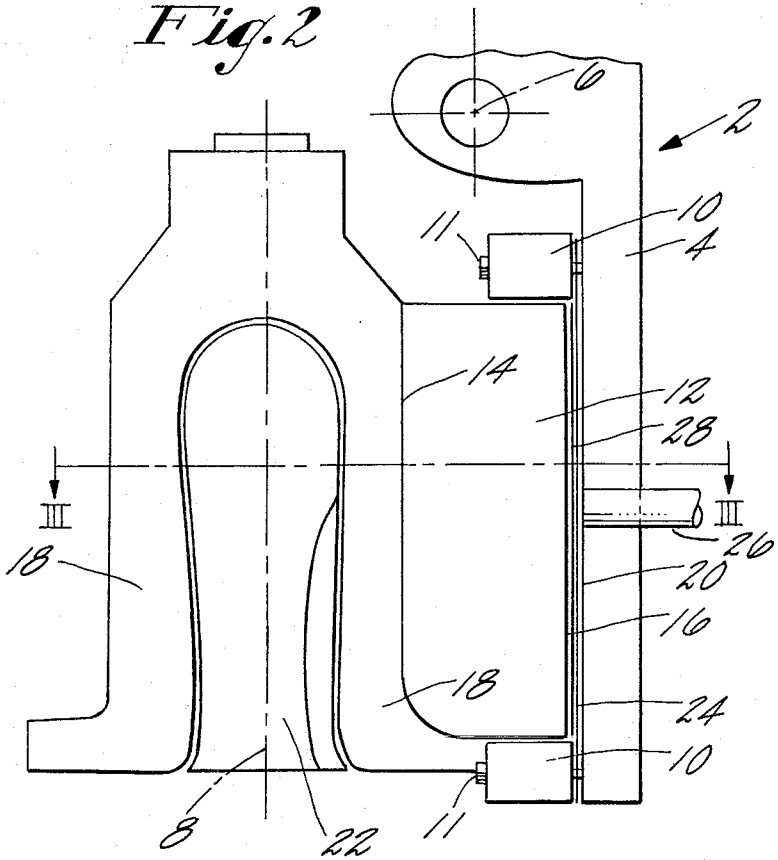
FIG. 2 is a view of a portion of a backpart molding machine in a vertical section.
Figure 1:
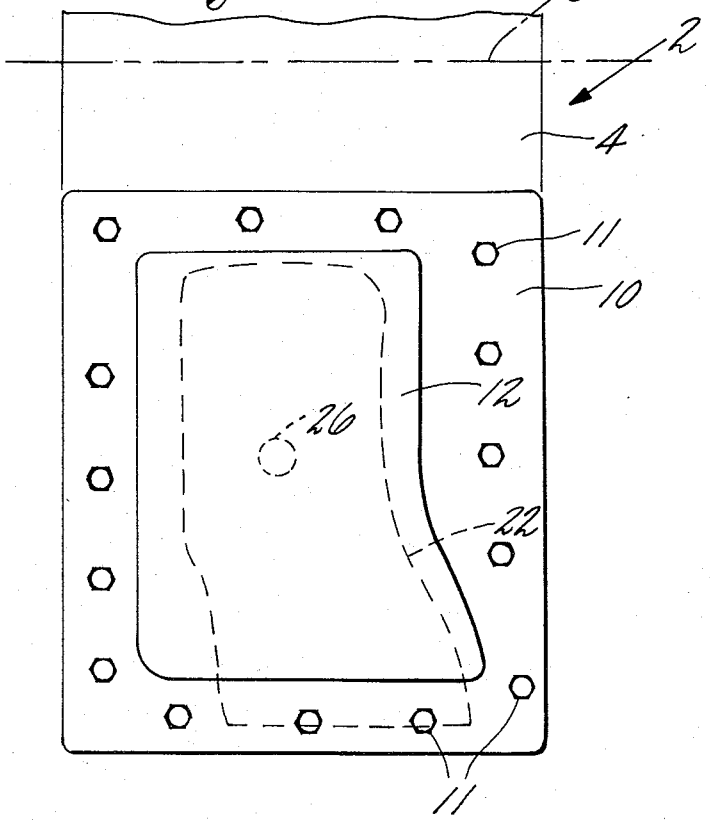
FIG. 1 shows a side view of an outer mold of a backpart molding machine constructed according to the principles of the present invention.
Figure 3:
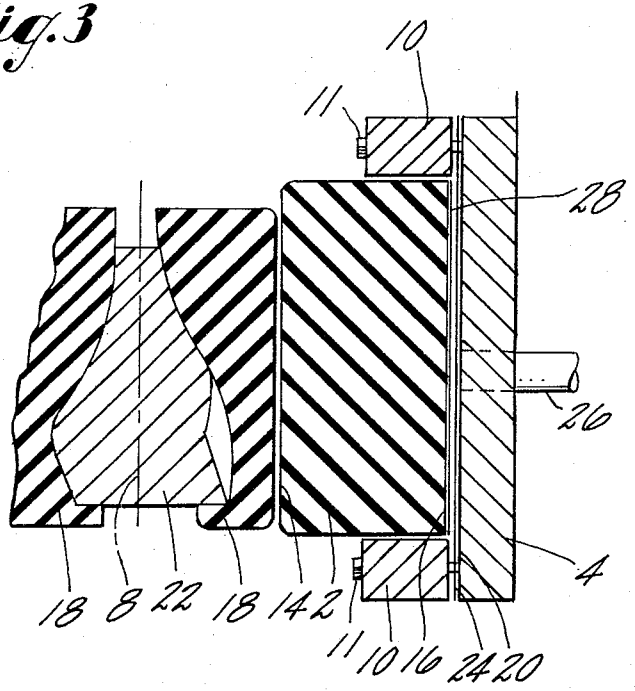
FIG. 3 is a view taken along the horizontal lines III—III of FIG. 2.

Referring now to the drawings in detail and particularly to FIG. 1, there is shown an outer mold arrangement 2 of a shoe backpart molding machine. The outer mold arrangement 2 comprises a support portion 4 which is mounted for pivotal movement about an axis 6. A support portion generally similar to the support portion 4, may be symmetrically arranged about a central plane 8 of the outer mold arrangement 2, which support portion has been left out of the figures. A generally rectangular frame 10 may be secured by a plurality of bolts 11 or the like to the support portion 4. The frame 10, may be constructed of aluminum, while the support portion 4 may be constructed of cast iron. A block 12 is slidingly arranged within the frame 10. The block 12 may be comprised of an elastic material of high hardness, for example rubber, with a Shore hardness of 65. The rubber block 12 has a front face 14 and a rear face 16 which are each generally flat and parallel to one another. The front face 14 lies against the mold cushion 18. It may be connected therewith, however, it may be separable from the mold cushion 18, thus permitting an easier exchange of the mold cushion 18 and/or the block 12. The rear face 16 is flat and parallel with a front face 20 of the support portion 4. In the cross-sectional views shown in FIGS. 2 and 3, the block 12 is shown as generally rectangular. The front end of the block is rounded in order to enable it to be accommodated with the mold cushion 18 and the mold cushion 18 to be accommodated with the inner mold 22. A cover 24, preferably comprised of rubber, is arranged between the block 12 and the support portion 4. The cover 24 is sealingly secured between the frame 10 and the support portion 4 which when closed off, defines an air cushion therebetween wherein air under pressure may be admitted through an inlet pipe 26 from a pressurizable air source, not shown. The air cushion formed between the cover 24 and the support portion 4 within the frame 10 is air tight along its sides and with the block 12. An intermediate disc 28 of thermoplastic polyester is loosely mounted between the block 12 and the cover 24 in order to prevent friction between the cover 24 and the block 12 when inflating and deflating the air cushion.

In operation of the shoe backpart molding machine, the whole outer mold arrangement 2, is first lowered towards the inner mold 22, so they meet in the region of a back seam on a shoe upper not shown, which is necessarily laid over the inner mold 22. The support portions 4 are then swung inwardly. The mold cushion 18 is thus caused to press on the shoe upper in the region of the side surfaces thereof against the inner mould 22. After closure of the support portions 4, air, or other fluids, under pressure is admitted to the air cushion through the inlet pipe 26 by activation of proper controls, not shown. The cover 24 is thereby pressed away from the front face 20 of the side portion 4. The cover 24 in turn presses on the intermediate disc 28 and thus on the block 12 which slides forwardly within the frame 10 and against the inner mold 22 to exert a pressure on the mold cushion 18 which would press a shoe upper lying on the inner mold 22 uniformily and with a predetermined pressure against the inner mold 22. Thus, a shoe upper and lining, not shown in the Figures, would be reliably pressed with the backseam being pressed flat against the uppermost portion of the inner mold 22, and the edge of the upper with its adjacent lining ironed flat thereadjacent. The lasting margin of a shoe upper therein may be formed in a known manner with a known heated lasting wiper arrangement, not shown, to effectuate heel lasting.

The block 12 or the cover 24 may be changed by releasing the bolts 11 from the frame 10 and replacing the respective item. Friction between the side walls of block 12 and the inner walls of the frame 10 may be minimized by an addition of slipping or friction reducing means such as talc.

Thus there has been shown a backpart molding machine wherein an arrangement of blocks under air pressure are moved only a minimum amount, reducing the wear and stress on various moving parts. The mold arrangement is easier to assemble, dismantle and maintain, and is more economical.

It is intended that the appended claims for the present invention be interpreted as examplary only and not in a limiting sense.

I claim:

1. A backpart molding machine for molding the backpart of a shoe upper therewith, said machine comprising:

an inner form;

an outer form which, together with the inner form, molds the backpart of an upper therebetween, and which outer form comprises a pair of pivotable support portions, at least one mold cushion of elastic material and an air cushion arrangement formed between said support portion and said mold cushion, wherein each support portion has a block which is movable in a direction towards said inner form when the air cushion is inflated.

2. A backpart molding machine as recited in claim 1 wherein said block extends over the whole side region of said inner form.

3. A backpart molding machine as recited in claim 2 wherein said block is made of an elastic material having a high hardness.

4. A backpart molding machine as recited in claim 3 wherein said machine includes a frame on said support portion for guiding said block.

5. A backpart molding machine as recited in claim 4 wherein said machine includes an air-tight cover between said support portion and said block.

6. A backpart molding machine as recited in claim 5 wherein said cover is fixed between said frame and said support portion.

7. A backpart molding machine as recited in claim 6 wherein the surface of said block facing away from said inner form is shaped to the surface of said support portion facing said inner form.

8. A backpart molding machine as recited in claim 7 wherein the rear face of said block and the front face of said support portion are essentially flat.

9. A backpart molding machine as recited in claim 8 wherein the surface of said block facing said inner form is essentially flat and is formed parallel to the central plane of said inner form.

10. A backpart molding machine as recited in claim 9 including a rigid disc which is mounted for movement between said block and said cover.

11. A backpart molding machine as recited in claim 10 having an air feed inlet arranged in said support portion to direct pressurized air to said air cushion.

12. A backpart molding machine as recited in claim 11 wherein the side surfaces of said block which slide in said frame are provided with a sliding surface.

* * * * *